US008234799B2

(12) United States Patent
Kokavec

(10) Patent No.: US 8,234,799 B2
(45) Date of Patent: Aug. 7, 2012

(54) DETACHABLE CLEAT ARRANGEMENT

(75) Inventor: Mark Michael Kokavec, Ellicott City, MD (US)

(73) Assignee: Under Armour, Inc., Baltimore, MD (US)

( * ) Notice: Subject to any disclaimer, the term of this patent is extended or adjusted under 35 U.S.C. 154(b) by 1001 days.

(21) Appl. No.: 12/207,683

(22) Filed: Sep. 10, 2008

(65) Prior Publication Data

US 2009/0077833 A1 Mar. 26, 2009

Related U.S. Application Data

(60) Provisional application No. 60/993,179, filed on Sep. 10, 2007.

(51) Int. Cl.
*A43C 15/00* (2006.01)
*A43C 5/00* (2006.01)

(52) U.S. Cl. ..... 36/134; 36/62

(58) Field of Classification Search ..... 36/134, 36/114, 61, 62, 64–66, 67 A, 67 D
See application file for complete search history.

(56) References Cited

U.S. PATENT DOCUMENTS 3,566,489 A * 3/1971 Morley ..... 36/67 D
4,633,600 A * 1/1987 Dassler et al. ..... 36/134
5,289,647 A * 3/1994 Mercer ..... 36/134
5,655,317 A * 8/1997 Grant ..... 36/134
5,956,871 A * 9/1999 Korsen ..... 36/134
5,957,642 A * 9/1999 Pratt ..... 411/55
5,960,568 A * 10/1999 Bell et al. ..... 36/134
6,021,590 A * 2/2000 Morimoto et al. ..... 36/134
6,154,984 A * 12/2000 Adam ..... 36/134
6,823,613 B2 * 11/2004 Kelly et al. ..... 36/134
7,047,675 B2 * 5/2006 Briant et al. ..... 36/134
7,076,894 B2 * 7/2006 Santos et al. ..... 36/134
7,107,708 B2 * 9/2006 Kelly et al. ..... 36/134
7,412,784 B1 * 8/2008 Bobbett ..... 36/67 R
2005/0217149 A1 * 10/2005 Ho ..... 36/59 R

* cited by examiner

*Primary Examiner* — Khoa Huynh
*Assistant Examiner* — Melissa Lalli
(74) *Attorney, Agent, or Firm* — Maginot, Moore & Beck

(57) ABSTRACT

A cleat arrangement is configured for use with an article of footwear comprises a receptacle, a cleat, and a retaining ring. The receptacle is provided in the sole of the footwear. The cleat includes a projecting member and a retaining surface. The retaining surface is configured to fit within the receptacle with the projecting member extending from the receptacle. The retaining ring fits over the cleat and engages the retaining surface of the cleat positioned within the receptacle and the projecting member of the cleat extending through the retaining ring. The retaining ring releasably engages the receptacle such that the retaining ring holds the cleat within the receptacle.

20 Claims, 12 Drawing Sheets

DETACHABLE CLEAT ARRANGEMENT

CROSS-REFERENCE TO RELATED APPLICATIONS

This application claims the benefit of earlier filed U.S. Provisional Application No. 60/993,179, filed Sep. 10, 2007.

FIELD

The present application relates to field of footwear, and particularly, to footwear having detachable cleats provided on the sole.

BACKGROUND

Many shoes or other articles of footwear include cleats designed to provide traction or a gripping function for the shoe when standing, walking, or running on soft ground. Examples of such shoes that may have cleats include hiking shoes or other athletic shoes, such as baseball shoes, soccer shoes, football shoes, or golf shoes. The term "cleat" as used herein is intended to refer to any member arranged on the underside of footwear (such as, for example, on the sole of the footwear) in order to provide traction or gripping ability for the wearer of the footwear, Examples of cleats include, without limitation, spikes, studs, blades and other protrusions provided on such shoes.

If the shoes are to be used on different ground conditions, it is advantageous if the cleats are releasably attached to the sole to allow the shoes to be adapted to the different ground conditions. For example, shorter cleats may be desired on a relatively dry field, and longer cleats may be desired on a relatively muddy field. In addition to being able to adapt the shoe to a particular ground condition, replaceable cleats on a shoe are also desirable such that old and worn cleats may be easily replaced without the need for a new shoe.

Releasable cleats are typically attached to the soles of shoes using threaded posts that engage a receptacle on the sole of the shoe having complimentary threads. The cleats are rotated by the user until they are tightened on the shoe. However, the ending orientation of the spike is difficult to determine, as the cleat is typically rotated until it is tight against the sole of the shoe, without regard for the ending orientation of the cleat. Although the ending orientation of the cleat is sometimes unimportant, such as the case with relatively round/conical studs, other cleats are directional in nature and their orientation may indeed be important. Examples of directional cleats include, without limitation, blades for baseball or soccer cleats and various other cleats that are not substantially round or conical.

Another issue with some cleats is that the traditional threaded post arrangement often results in cleat pressure that may be felt on the interior of the shoe when the cleat is tightened against the sole of the shoe. In particular, the wearer of the shoe may be able to feel the end of the center threaded post pushing against the sole of the foot when walking or running. Of course, this may be uncomfortable for the wearer.

Accordingly, it would be advantageous to provide a shoe with detachable cleats that may be oriented in any of several different directions when secured to the shoe. It would also be advantageous if a single shoe could be used for different types of cleats, such as a single shoe accommodating football studs, golf spikes, baseball spikes or soccer cleats. In addition, it would be advantageous if such cleats could reduce or eliminate cleat pressure.

SUMMARY

A cleat arrangement is configured for use with an article of footwear. In at least one embodiment, the cleat arrangement comprises a receptacle, a cleat, and a retaining ring. The receptacle is provided in the sole of the footwear. The cleat includes a projecting member and a retaining surface. The retaining surface is configured to fit within the receptacle with the projecting member extending from the receptacle. The retaining ring fits over the cleat and engages the retaining surface of the cleat positioned within the receptacle with the projecting member of the cleat extending through the retaining ring. The retaining ring releasably engages the receptacle such that the retaining ring holds the cleat within the receptacle.

In at least one embodiment, the cleat arrangement includes a directional locking surface, a receptacle, a cleat, and a retaining member. The directional locking surface is provided within the receptacle on a cleat platform. The cleat includes a complimentary locking surface that engages the directional locking surface when the cleat is positioned within the receptacle. The cleat may be oriented in one of at least two different orientations when the directional locking surface engages the complimentary surface on the cleat. The retaining member engages both the cleat and the receptacle to hold the cleat within the receptacle.

In at least one embodiment, the cleat arrangement includes a sole member, a receptacle, a cleat, and a retaining member. The receptacle is provided on the sole member with a cleat platform of the sole member extending into the receptacle. The cleat platform includes a directional locking surface configured to engage the cleat. The cleat includes a complimentary locking surface on one side and a projecting member on the opposite side. The complimentary locking surface of the cleat is configured to engage the directional locking surface of the cleat platform when the cleat is positioned within the receptacle. The cleat may be oriented in one of at least two different orientations when the directional locking surface of the sole engages the complimentary surface on the cleat. The retaining member fits over the cleat with the projecting member of the cleat extending through the retaining member. The retaining member includes threads that engage complimentary threads on the receptacle. When the retaining member is rotated relative to the receptacle, the threads of the retaining member engage the complimentary threads of the receptacle to tighten the retaining member in the receptacle and hold the cleat within the receptacle.

The above described features and advantages, as well as others, will become more readily apparent to those of ordinary skill in the art by reference to the following detailed description and accompanying drawings.

DESCRIPTION

Figure 1:
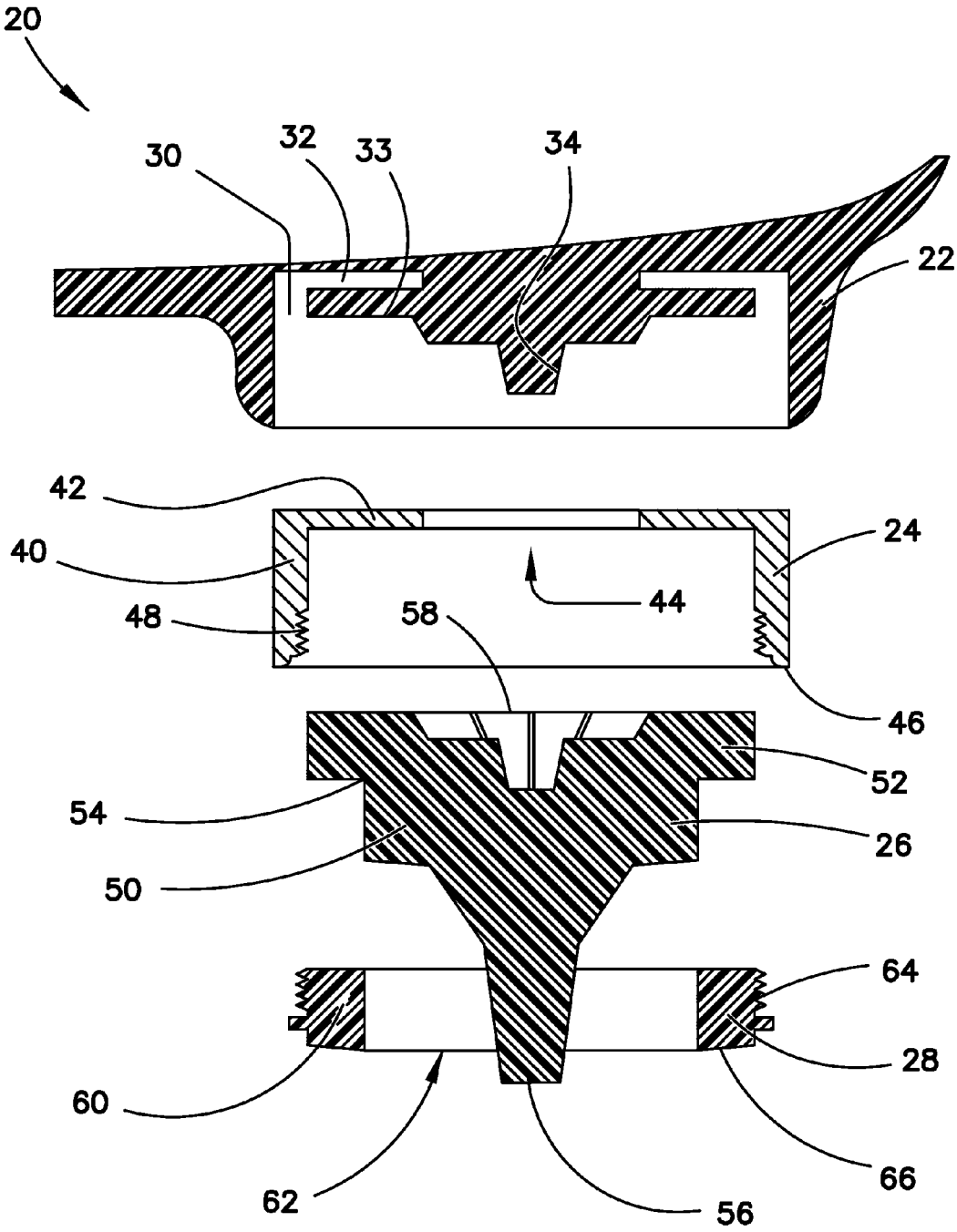
FIG. 1 shows an exploded isometric cross-sectional view of a detachable cleat arrangement.
Figure 2:
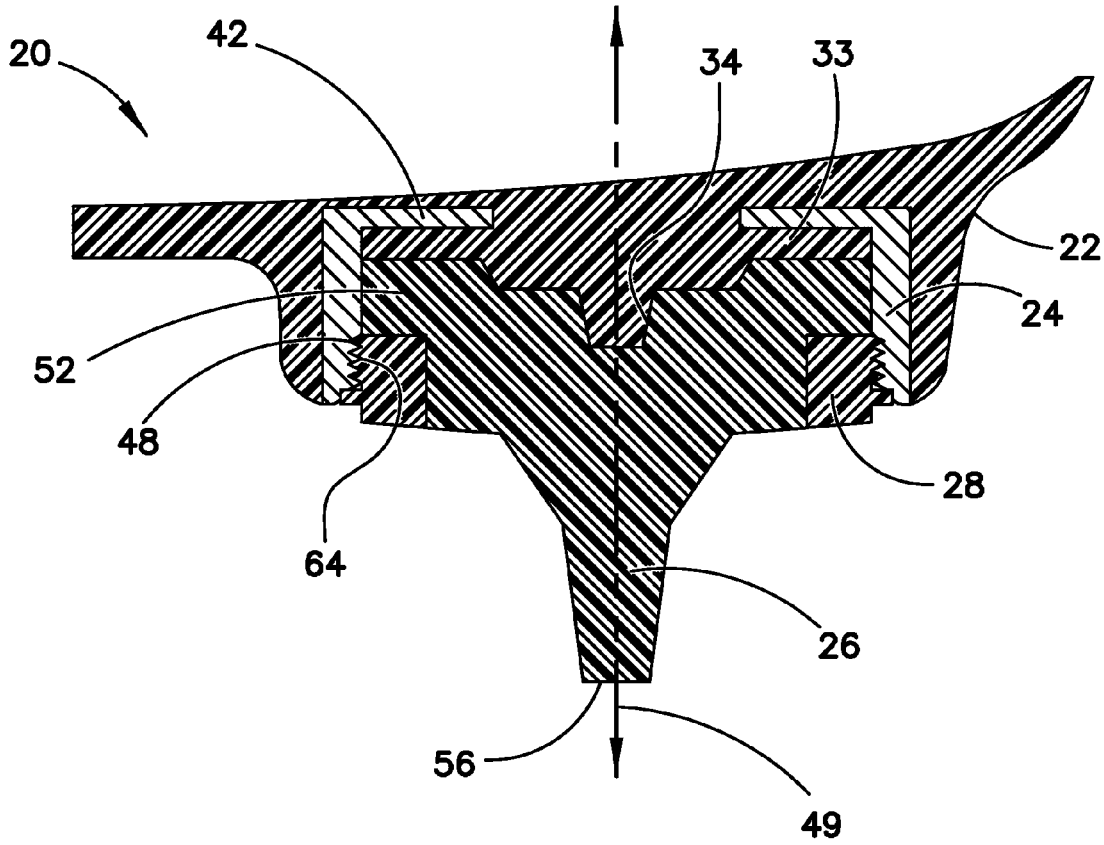
FIG. 2 shows a cross-sectional view of the assembled detachable cleat arrangement of FIG. 1.
Figure 3:
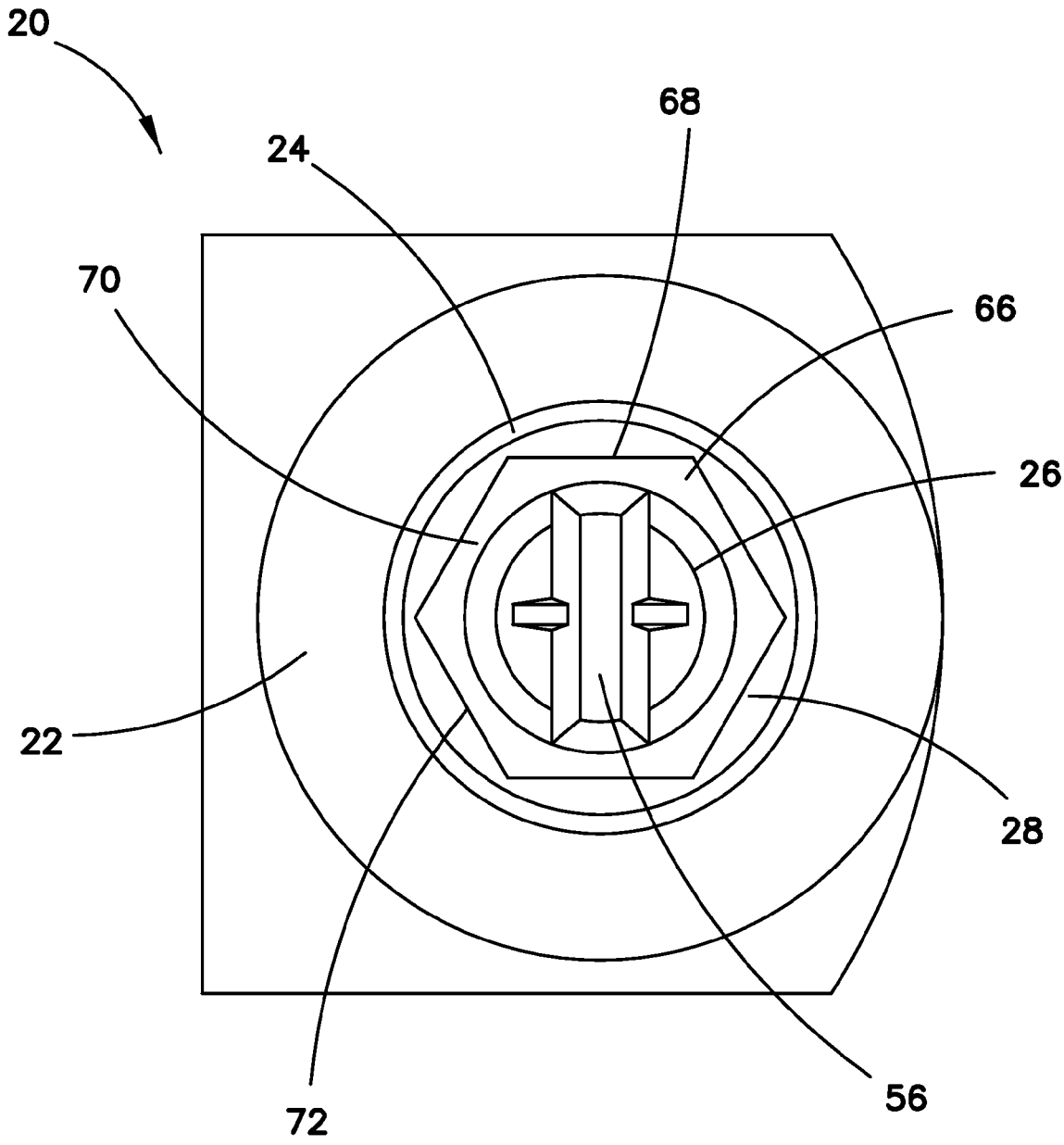
FIG. 3 shows a bottom view of the detachable cleat arrangement of FIG. 2.

With general reference to FIGS. 1-3, and with additional perspective from FIGS. 10A-10D, a detachable cleat arrangement 20 comprises a receptacle 24 positioned upon a sole member 22 of an article of footwear, such as a shoe. The receptacle 24 is configured to receive a cleat 26. A retaining member 28 engages the receptacle 24 and holds the cleat 26 within the receptacle 24.

The sole member 22 may be an inner sole or an outer sole of a shoe, such as an athletic shoe. If the sole member 22 is an inner sole, the outer sole of the shoe will include a hole configured to pass portions the cleat retaining portions of the inner sole. In particular, the hole in the outer sole provides for passage of the receptacle 24 and that portion of the inner sole that holds the receptacle to the exterior of the shoe. The sole member 22 may be made from any of numerous different materials known in the art for sole members. For example, if the sole member is an inner sole, the sole member may comprise a relatively rigid plastic material covered by a cushioning layer. If the sole member 22 is an outer sole, the sole member may be comprised of a relatively rigid plastic material or a rubber-like plastic material. It will be recognized that different materials may be used for the sole 22, depending upon the particular design and intended use of the shoe.

In the embodiment of FIG. 1, the sole member 22 includes at least one cavity 30 configured to hold a receptacle 24. The cavity 30 is generally cylindrical in shape. The cavity 30 includes a disc-shaped portion 32 near the top of the cavity. A cleat platform is provided in the cavity 30. The cleat platform 33 includes a contoured surface 34 that is designed to engage the cleat 26. As discussed in further detail below, the contoured surface 34 is configured to engage complimentary surface 58 on the cleat 26 and thus provide a directional locking surface for the cleat 26.

With continued reference to FIGS. 1-3, the receptacle 24 is provided on and fixedly retained by the sole member 22. The receptacle 24 includes a cylindrical portion 40 with an upper flange member 42, a central upper hole 44, a bottom rim 46, and a threaded portion 48 on the interior wall of the cylindrical portion 40.

The cylindrical portion 40 of the receptacle 24 is configured to fit within the cavity 30 of the sole member 22. In the embodiment of FIGS. 1-3, the upper flange 42 of the receptacle 24 fits within the disc shaped portion 32 of the cavity 30. Accordingly, the sole member 22 may be molded around the receptacle 24 such that the material for the sole member 22 encases the upper flange 42 of the receptacle 24. When the sole member 22 is molded on the receptacle 24 in this fashion, the sole member 22 locks the receptacle 24 to the sole member. The receptacle 24 is further positioned in the sole member 22 such that the contoured surface 34 of the sole member 22 is positioned within the receptacle 24, below the flange 42. Also, when the receptacle 24 is positioned in the cavity 30 of the sole member 22, the bottom rim 46 of the receptacle 24 is flush with the bottom surface of the sole member 22. In at least one alternative embodiment, the receptacle 24 may be integrally formed as part of the sole member 24.

Figure 5A:
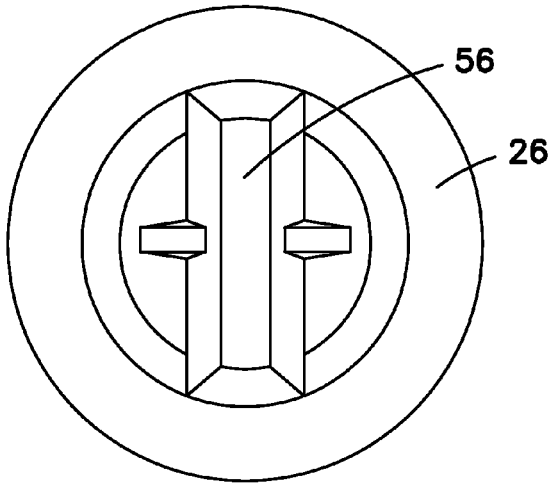
FIGS. 5A-5C show possible orientations for the projecting member of the cleat of the detachable cleat arrangement of FIG. 1.
Figure 5B:
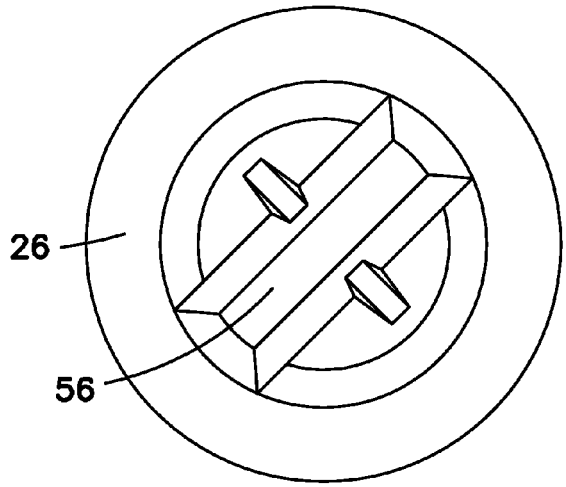

The cleat 26 of the arrangement 20 includes a main body 50 with an upper flange 52 forming a shoulder 54 with the main body 50. As explained in further detail below, the flange 52 and shoulder 54 provide a retaining surface to assist in securing the cleat 26 in the receptacle 24. A projecting member 56, such as, for example, a spike, stud, blade or other projection, extends downward from the main body 50 of the cleat 26. In the embodiment of FIGS. 1-3, the projecting member 56 is provided as a blade with a substantially rectangular cross-section. However, depending on the activity, different projecting members 56 may be utilized. For example, the projecting member 56 shown in FIGS. 5A and 5B is generally conical in shape with a substantially circular cross-section, as is commonly seen with football cleats. Of course numerous other projecting members 56 are possible in the detachable cleat arrangement. Examples of such differing cleats 26 that may be used with the detachable cleat arrangement described herein include stud designs, spike designs, side scoop cleat designs, conical cleat designs, as well as numerous other cleat designs including cleats with a single projection and cleats with multiple projections, as will be recognized by those of skill in the art.

With continued reference to FIGS. 1-3, a contoured surface 58 is provided on the cleat 26, opposite the projecting member 56. Accordingly, if the projecting member 56 is considered to extend downward, the contoured surface 58 is provided on the upper surface of the cleat 26. The contoured surface 58 is complimentary to the contoured surface 34 of the sole member 22. Accordingly, the contoured surface 34 of the sole member 22, which is convex, fits down into the contoured surface 58 of the cleat 26, which is concave. As discussed in further detail below, it will be appreciated that other complimentary arrangements are possible, such as where the contoured surface 34 of the sole member 22 is concave, and the contoured surface 58 of the cleat 26 is convex.

When the cleat 26 is positioned in the receptacle 24, the contoured surface 58 of the cleat 26 engages the contoured surface 34 of the sole member 22. In such engagement, the two surfaces 58, 34 are closely engaged with surface 58 complimentary to surface 34 such that surface 58 fits into surface 34 (or vice-versa). This complimentary arrangement locks the cleat 26 in a certain orientation relative to the sole member 22, and prevents the cleat 26 from rotating or spinning relative to the sole member 22. For example, the close engagement between the two contoured surfaces 58, 34 results in an arrangement where the cleat 26 can not rotate about a central axis 49 (see FIG. 2) which defines the cylindrical portion 40 of the receptacle 24.

Figure 9A:
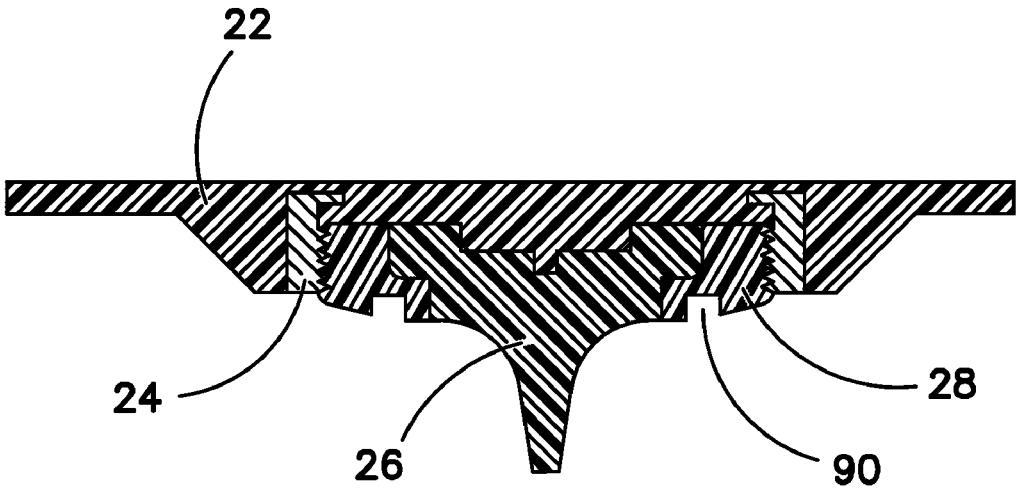
FIG. 9A shows a cross-sectional view of an alternative embodiment of the assembled detachable cleat arrangement of FIG. 2.
Figure 9B:
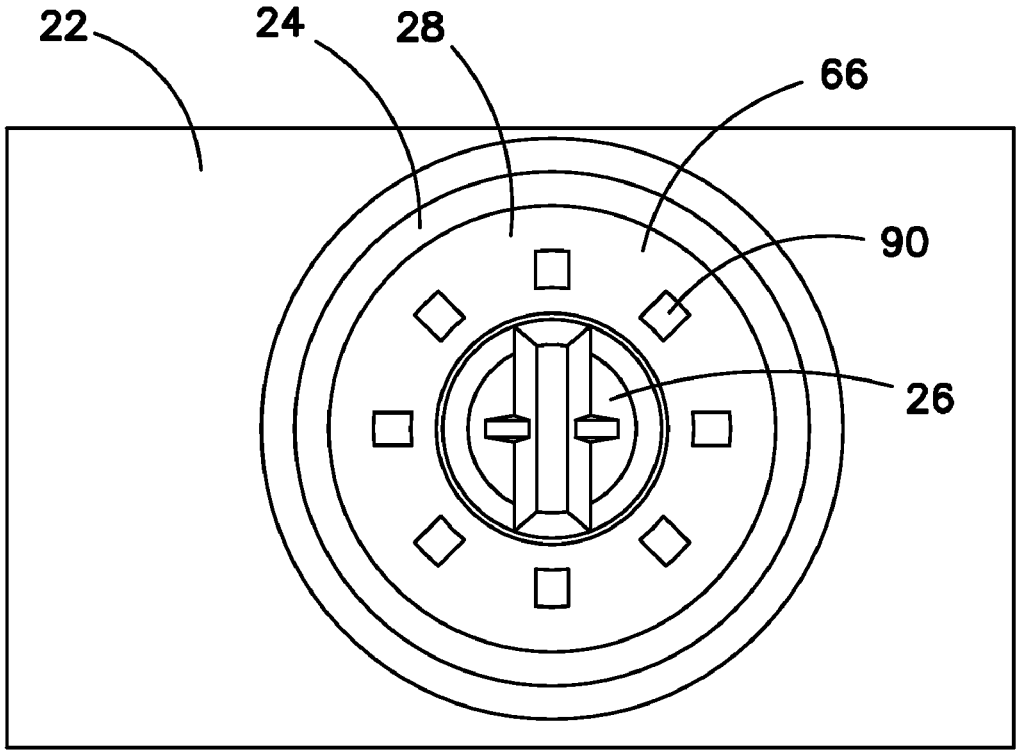
FIG. 9B shows a bottom view of the detachable cleat arrangement of FIG. 9A.
Figure 10A:
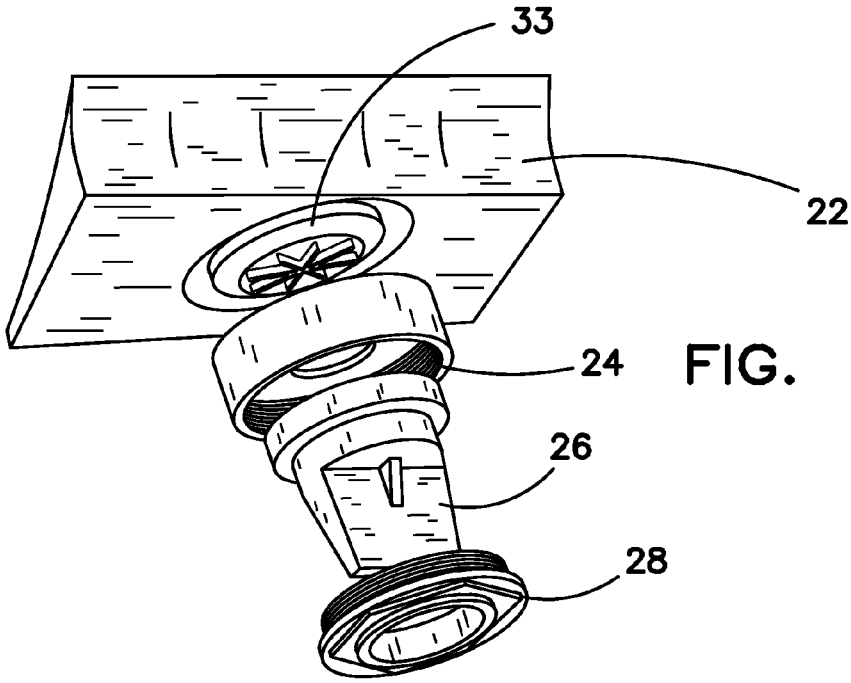
FIG. 10A shows an exploded isometric bottom view of the detachable cleat arrangement of FIG. 1.
Figure 10B:
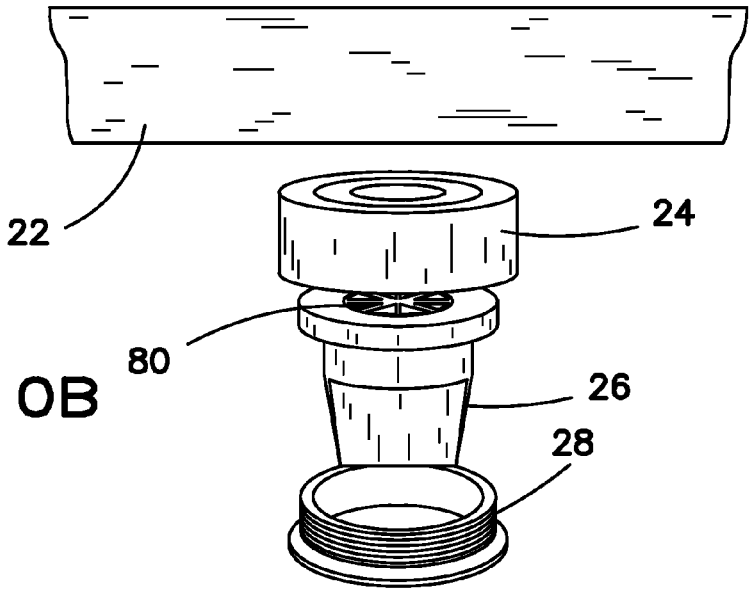
FIG. 10B shows an exploded isometric upper view of the detachable cleat arrangement of FIG. 10A.
Figure 10C:
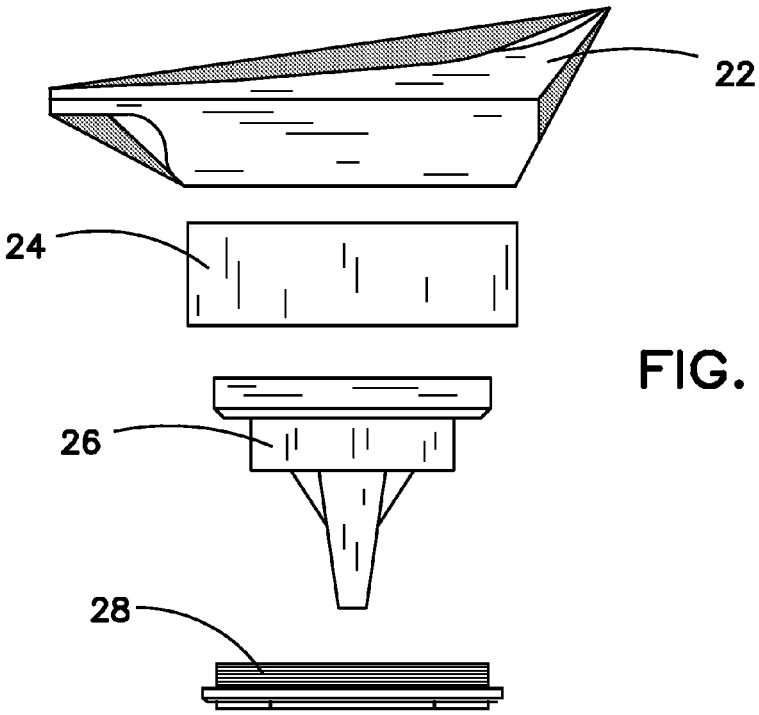
FIG. 10C shows an exploded side view of the detachable cleat arrangement of FIG. 10A.
Figure 10D:
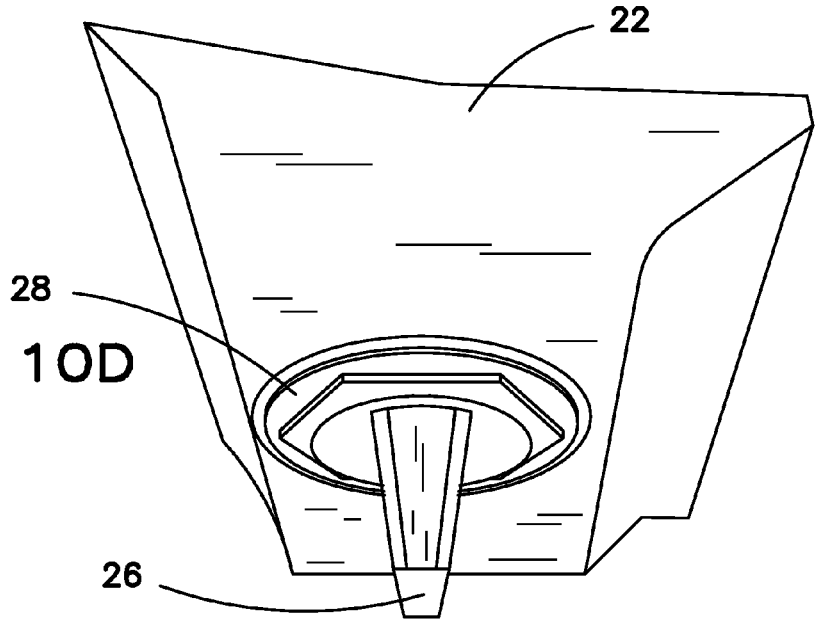
FIG. 10D shows a bottom perspective assembled view of the detachable cleat arrangement of FIG. 10A.

In the embodiment of FIGS. 1-3, the retaining member 28 is provided as a retaining ring that is defined by a circular wall 60 with a center hole 62. A threaded portion 64 is provided on the exterior of the circular wall 60. Furthermore, the bottom surface of the circular wall 60 provides a face 66 for the retaining member 28, as shown in FIG. 3. Tightening features 68 are provided on the face 66 of the retaining member 28. The tightening features 68 may include a hex-shaped surface 70 rising up on the face 66. The hex-shaped surface defines ridges 72 which provide a grip portion allowing a wrench to engage the retaining ring 28. In the embodiment of FIG. 3, the ridges 72 are configured to engage a hex-shaped wrench, allowing the retaining ring 28 to be rotated by the wrench. It will be recognized that other tightening features may be provided on the retaining ring, such as the slots 90 shown in the embodiment of FIGS. 9A and 9B. These slots 90 are configured to engage a wrench having a plurality of protrusions extending therefrom which fit in the slots. When the wrench protrusions engage the slots 90, rotation of the wrench results in rotation of the retaining ring 28. The retaining member 28 does not directly engage the directional locking surface 34.

With continued reference to FIGS. 1-3, the retaining ring 28 is used to secure the cleat 26 in the receptacle 24. Accordingly, with the cleat 26 positioned in the receptacle 24, the projecting member 56 of the cleat 26 is passed through the hole 62 in the retaining ring 28. The threaded portion 64 of the retaining ring 28 is then brought into engagement with the threaded portion 48 of the receptacle 24, and the retaining ring 28 is rotated. Rotation of the retaining ring 28 causes the threads on the retaining ring 28 to engage the complimentary threads on the receptacle 24. The retaining ring 28 is rotated until the circular wall 60 of the retaining ring is fully engaged with the shoulder 54 of the cleat 26 abutting the flange 52. When the retaining ring 28 is completely tightened in the receptacle 24 against the flange 52 of the cleat 26, the cleat is locked in place in the receptacle 24 and can not be pulled out in the direction of central axis 49. Furthermore, as discussed above, because the cleat 26 includes a contoured surface 58 that engages the complimentary contoured surface 34 provided on the cleat platform 33, the cleat 26 does not rotate in the receptacle 24 about the central axis 49.

While the retaining member 28 has been described as having threads to engage the receptacle 24, other embodiments of the detachable cleat arrangement may involve different mechanisms to secure the retaining member 28 within the receptacle. For example, in one embodiment, the retaining member 28 may be snap-fit into the receptacle in order to lock the cleat 26 in the receptacle 24.

Figure 4:
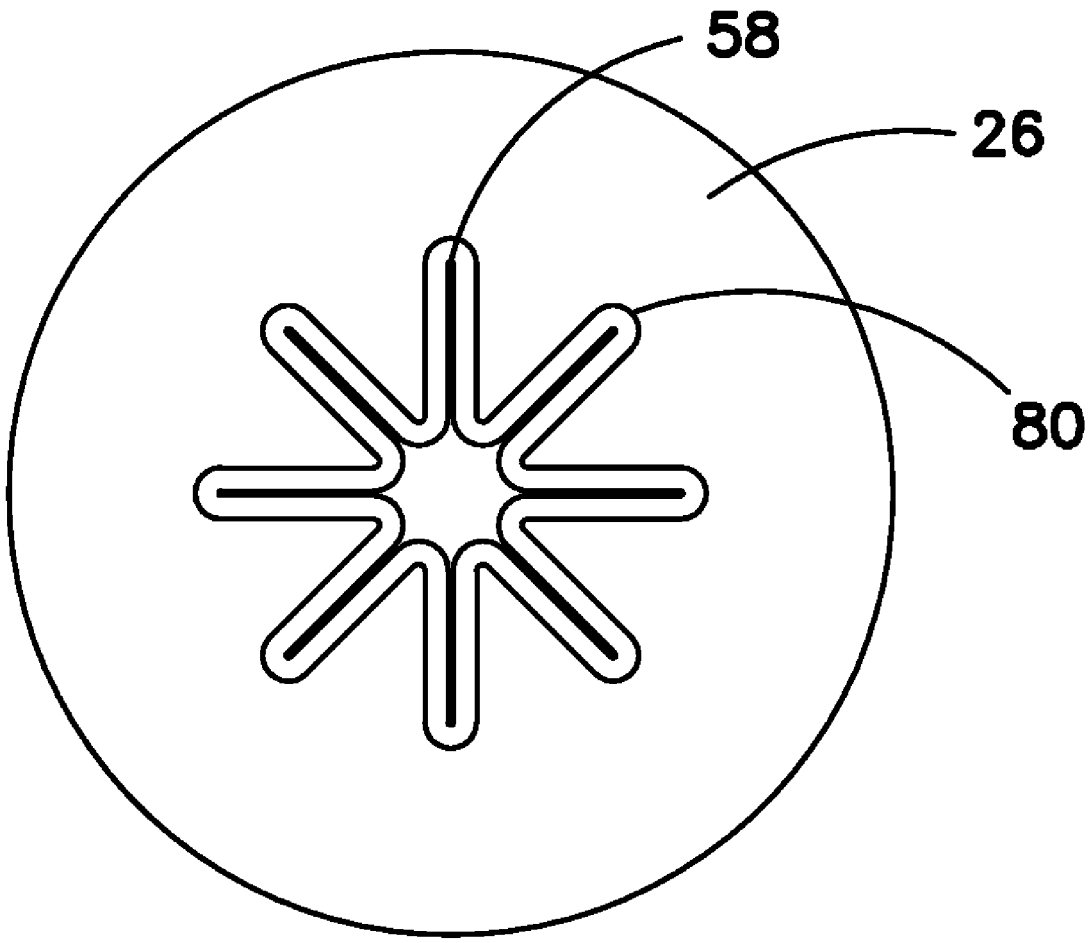
FIG. 4 shows the contoured upper surface of the cleat of the detachable cleat arrangement of FIG. 1.
Figure 5C:
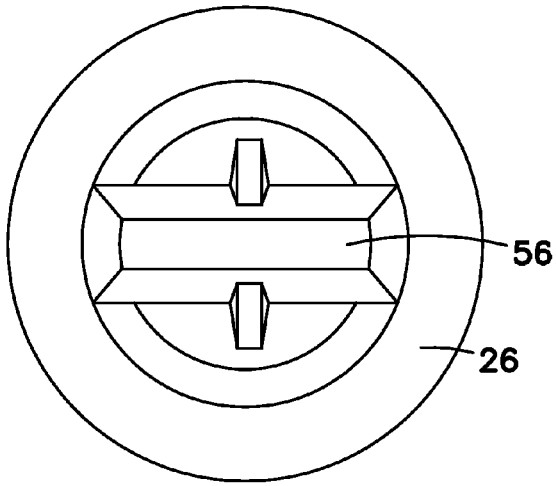

FIG. 4 shows a more detailed look at one embodiment of the upper contoured surface 58 of the cleat 26. As shown in FIG. 4, the contoured surface 58 may be an eight-pointed star arrangement 80 configured to engage a complimentary eight-pointed star arrangement provided as the contoured surface 34 of the sole member 22. The eight-pointed star arrangement 80 on the cleat 26 of FIG. 4 may have a concave surface where the shape is formed as a depression in the cleat 26. In this case, the complimentary eight-pointed star arrangement serving as the contoured surface 34 of the sole member 22 would have a convex surface that extends outward from the cleat platform 33, allowing it to engage the complimentary eight-pointed star arrangement 80 on the cleat 26. Because the eight-pointed star arrangement 80 is symmetric at 45° angles, the cleat 26 may be rotated and locked in place relative to the sole 22 at such 45° angles. For example, FIGS. 5A-5C show the possible orientations of the cleat 26 relative to the sole 22 with the eight point star arrangement 80 of FIG. 4. In this embodiment, the projecting member 56 is a blade with a substantially rectangular cross-sectional shape. As shown in FIG. 5A, the blade 56 may be locked to the cleat platform 33 in a 0° orientation, where the blade is generally aligned with the longitudinal axis defined along the bottom of the sole 22. As shown in FIG. 5B, the blade 56 may be locked to the cleat platform 33 in a 45° orientation, with the blade at a 45° angle relative to the longitudinal axis along the bottom of the sole. As shown in FIG. 5C, the blade 56 may be locked to the cleat platform 33 in a 90° orientation, with the blade at a 90° angle relative to the longitudinal axis along the bottom of the sole.

Figure 6:
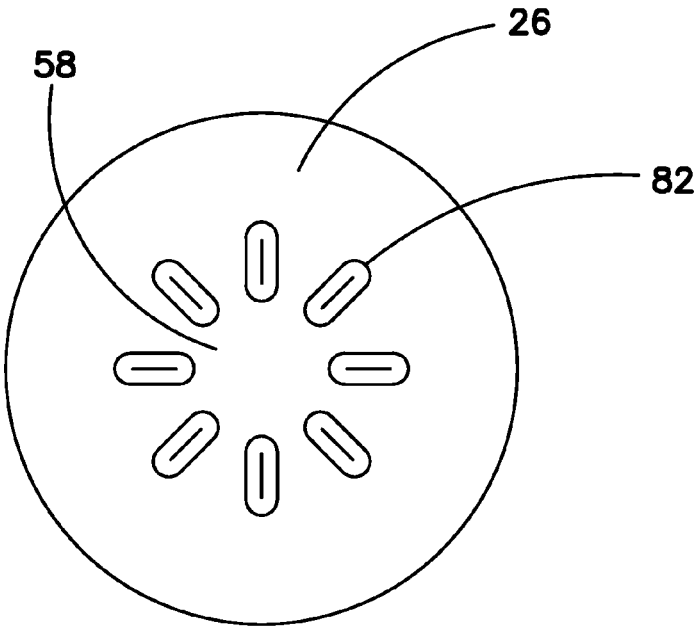
FIG. 6 shows an alternative embodiment of the contoured upper surface of FIG. 4.
Figure 7:
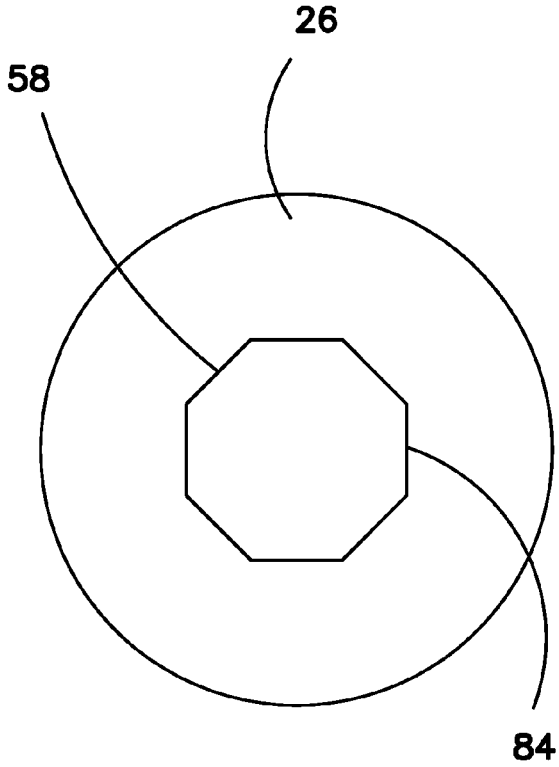
FIG. 7 shows another alternative embodiment of the contoured upper surface of FIG. 4.
Figure 8A:
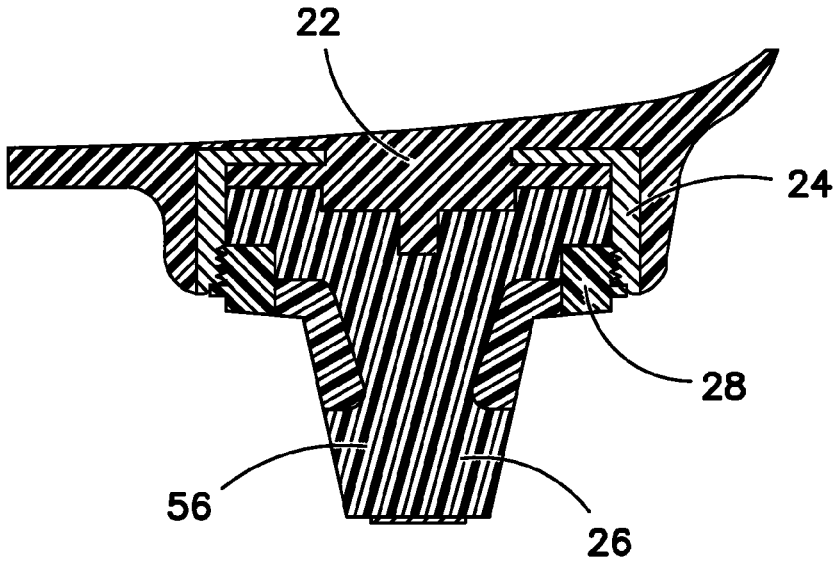
FIG. 8A shows a cross-sectional view of an alternative embodiment of the assembled detachable cleat arrangement of FIG. 2.
Figure 8B:
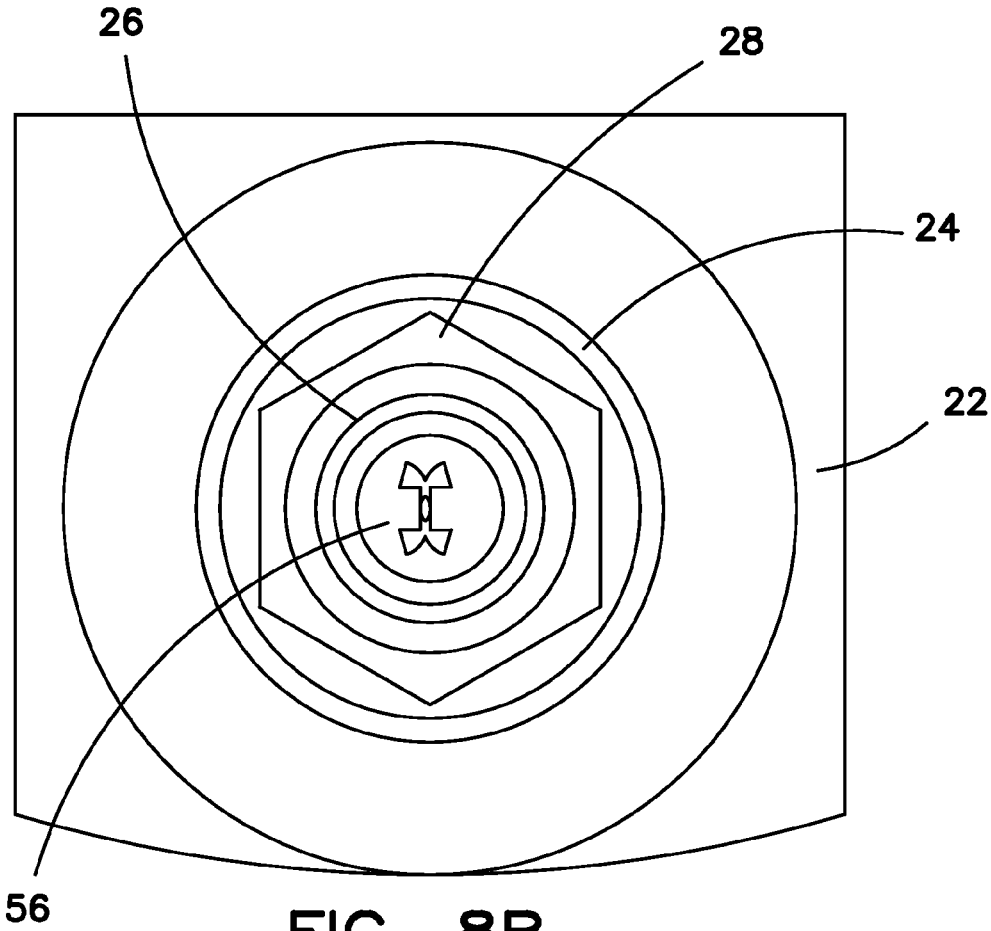
FIG. 8B shows a bottom view of the detachable cleat arrangement of FIG. 8A.

It will be appreciated that numerous other arrangements other than an eight-pointed star arrangement may be utilized as the complimentary contoured surfaces. For example, FIG. 6 shows an arrangement where the contoured surface 58 of the cleat 26 comprises of a plurality of slots 82. FIG. 7 shows an arrangement where the contoured surface 58 of the cleat 26 comprises an octagon surface 84. For each possible contoured surface 58 on the cleat 26, a complimentary contoured surface 34 is provided on the sole member 22. It will also be appreciated that in alternative embodiments, the contoured surface 34 of the sole member 22 could be concave and the contoured surface 58 on the cleat 26 could be convex. Furthermore, in other alternative embodiments, the directional locking features for the cleat could be provided on the receptacle 24, or other locations, instead of using a contoured surface 34 on the cleat platform 33. For example, in one alternative embodiment, the receptacle 24 could include a plurality of knobs on the interior sidewall of the receptacle 24 which engage notches formed on the flange 52 of the cleat to provide directional locking features for the cleat.

Figure 11A:
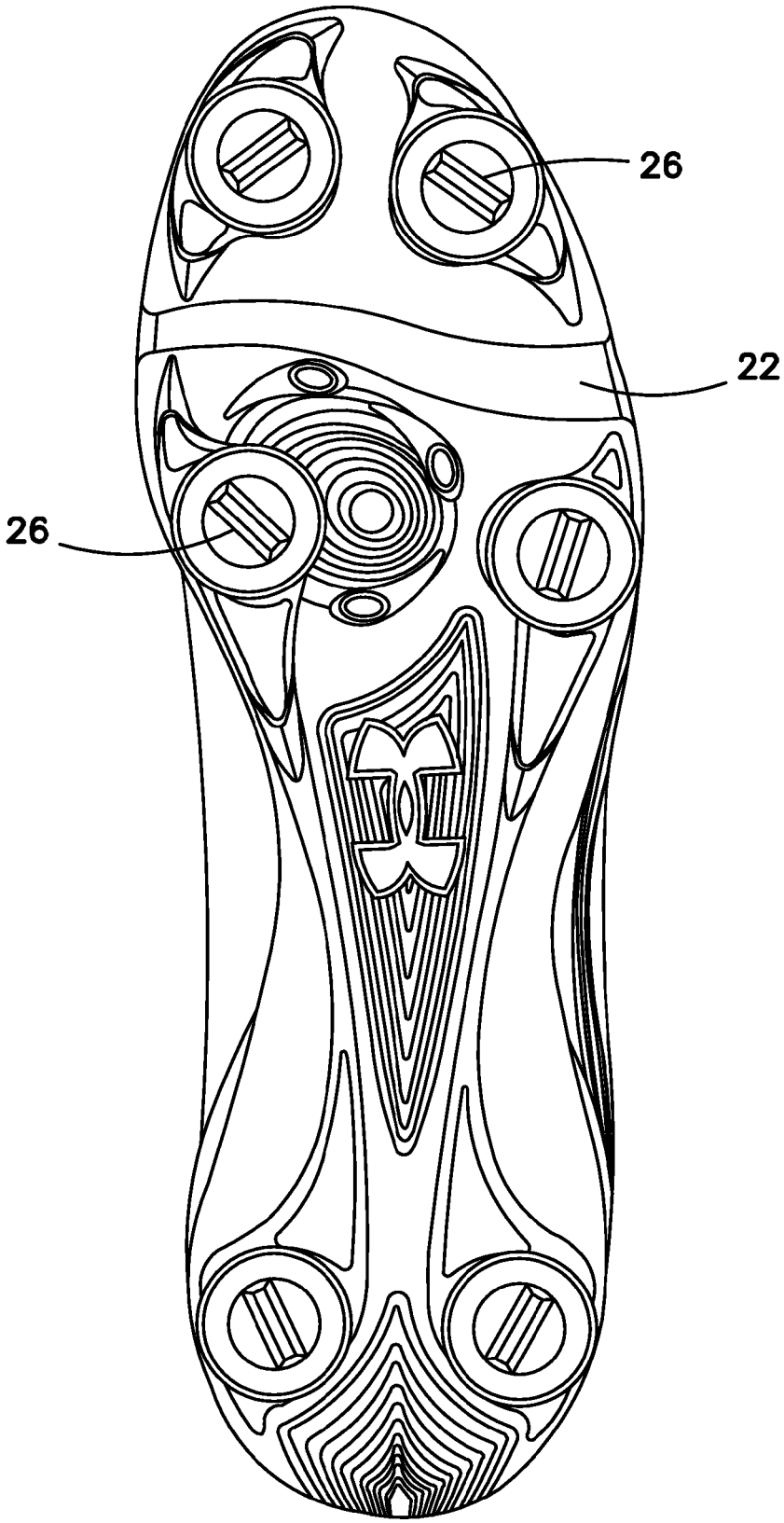
FIG. 11A shows a sole member utilizing the detachable cleat arrangement of FIG. 1.
Figure 11B:
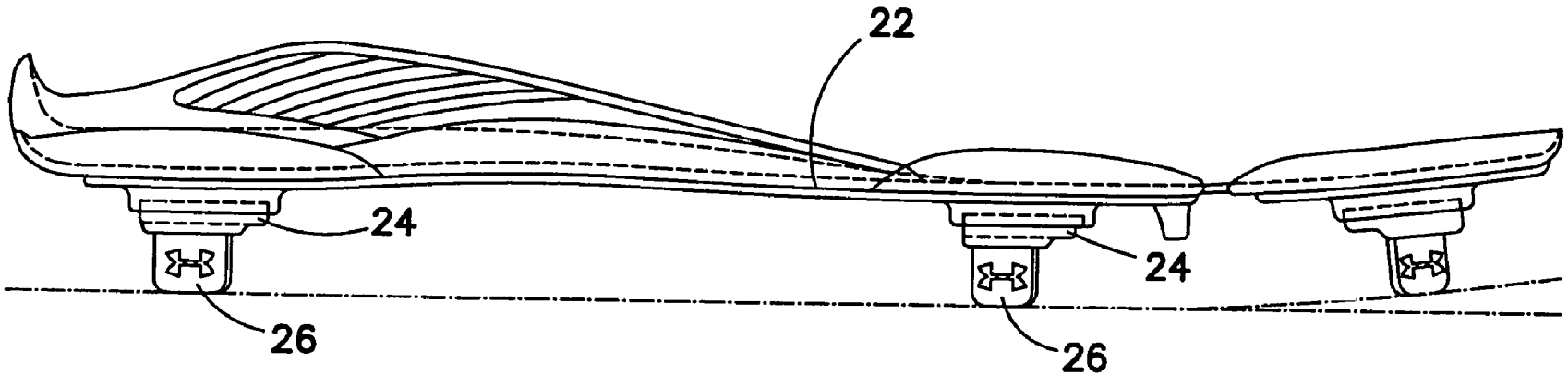
FIG. 11B shows a cross-sectional view of the sole member of FIG. 11A along a longitudinal axis of the sole member.

FIGS. 11A and 11B show a sole member 22 that incorporates the detachable cleat arrangement 20 described herein. The sole member 22 includes a plurality of cleats 26, each of which may be oriented in different directions, as chosen by the user. Also, because a significant portion of the cleat 26 is held within the sole member 22 and associated receptacle 24, a cleat arrangement is provided that allows the wearer to be closer to the ground. This is facilitated by the unique retaining feature described herein where the cleat 26 is not affixed to the sole with a post extending from the cleat, but is instead affixed to the sole using a retaining ring that fits over the cleat. With the overall height of the shoe reduced (from ground up), an athlete wearing the shoe is provided with the advantage of a lower center of gravity. In other words, by virtue of a shoe and cleat arrangement with a reduced profile, the athlete is actually positioned closer to the ground as compared with many prior art cleat arrangements.

In addition to the above, the disclosed embodiment discloses a cleat design that reduces or even eliminates cleat pressure experienced by the person wearing the cleat. As discussed previously, cleat pressure typically occurs through the center metal threaded post. The disclosed embodiment may reduce or even eliminate cleat pressure, as the forces that retain the cleat in the sole are provided on the outside area of the retaining ring, which provides a greater surface area for attachment of the cleat to the shoe, and also moves the fastening mechanism away from the inner sole of the shoe.

The members forming the cleat arrangement 20 described herein may advantageously be made from any of various different materials. Examples of such materials include plastic materials, metal materials, and components manufactured from a combination of different materials. For example, the members may be formed of steel, TPU, PBAX, or a combination of different materials formed from a multi-shot injection molding system. Accordingly, the cleat arrangement described herein is not limited to components manufactured from any particular materials.

Although the detachable cleat has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of any eventual claims should not be limited to the description of the preferred embodiments contained herein.

What is claimed is:

1. An article of footwear having a cleat arrangement comprising:

a sole including a cleat platform and an adjacent cavity;

a receptacle including an upper flange positioned in the cavity adjacent to the cleat platform;

a first contoured surface positioned in the receptacle;

a cleat including a projecting member, a second contoured surface, and a retaining surface, the second contoured surface configured to fit within the receptacle and engage the first contoured surface in a complimentary locking manner to prevent the cleat from rotating in the receptacle, the retaining surface configured to fit within the receptacle with the projecting member extending outward from the receptacle; and a retaining ring configured to releasably engage the receptacle and secure the cleat within the receptacle, the retaining ring configured to fit over the cleat and engage the retaining surface of the cleat positioned within the receptacle with the projecting member of the cleat extending through the retaining ring.

2. The article of footwear of claim 1 wherein the retaining ring includes a threaded portion configured to engage a complimentary threaded portion in the receptacle.

3. The article of footwear of claim 2 wherein the retaining ring includes a face with tightening features provided on the face.

4. The article of footwear of claim 1 wherein the first contoured surface is provided on the cleat platform.

5. The article of footwear of claim 1 wherein the receptacle is not integrally formed with the sole but is secured to the sole.

6. The article of footwear of claim 1 wherein the projecting member of the cleat comprises a blade with a substantially rectangular cross-section.

7. The article of footwear of claim 1 wherein the projecting member of the cleat is substantially conical in shape.

8. A cleat arrangement comprising:

a receptacle;

a directional locking surface provided within the receptacle on a cleat platform;

a cleat including one end with a complimentary locking surface and an opposite end with a projecting member, the complimentary locking surface engaging the directional locking surface when the cleat is positioned within the receptacle, wherein the complimentary locking surface selectively engages the directional locking surface in one of at least two different locking positions such that the projecting member is positioned and locked in one of at least two different orientations based on the selected locking position; and a retaining member engaging both the cleat and the receptacle such that the retaining member retains the cleat within the receptacle, wherein the retaining member is a retaining ring which includes locking threads configured to engage complimentary threads in the receptacle.

9. The cleat arrangement of claim 8 wherein the directional locking surface is provided as a star arrangement at a top of the receptacle.

10. The cleat arrangement of claim 8 wherein the projecting member extends through the retaining member.

11. The cleat arrangement of claim 10 wherein the projecting member is a blade shaped projecting member aligned along an axis when the cleat is oriented in a first orientation and aligned offset from the axis when the cleat is oriented in a second orientation.

12. The cleat arrangement of claim 8 wherein the retaining member includes a threaded portion configured to engage a complimentary threaded portion in the receptacle.

13. The article of footwear of claim 8 wherein the retaining member includes a face with tightening features provided on the face.

14. The cleat arrangement of claim 8 wherein the retaining member does not directly engage the directional locking surface.

15. A cleat arrangement comprising:

a sole of a shoe;

a receptacle positioned within the sole;

a directional locking surface provided within the receptacle on a cleat platform;

a cleat including one end with a complimentary locking surface and an opposite end with a projecting member, the complimentary locking surface engaging the directional locking surface when the cleat is positioned within the receptacle, wherein the complimentary locking surface selectively engages the directional locking surface in one of at least two different locking positions such that the projecting member is positioned and locked in one of at least two different orientations based on the selected locking position; and a retaining member engaging both the cleat and the receptacle such that the retaining member retains the cleat within the receptacle, wherein the sole includes a cavity adjacent to the cleat platform and wherein the receptacle includes an upper flange positioned in the cavity in order to secure the receptacle to the sole of the shoe.

16. The cleat arrangement of claim 15 wherein the directional locking surface is provided as a star arrangement at a top of the receptacle.

17. The cleat arrangement of claim 15 wherein the projecting member extends through the retaining member.

18. The cleat arrangement of claim 15 wherein the projecting member is a blade shaped projecting member aligned along an axis when the cleat is oriented in a first orientation and aligned offset from the axis when the cleat is oriented in a second orientation.

19. The cleat arrangement of claim 15 wherein the retaining member includes a threaded portion configured to engage a complimentary threaded portion in the receptacle.

20. The article of footwear of claim 15 wherein the retaining member includes a face with tightening features provided on the face.

* * * * *